US008496403B2

(12) United States Patent
Lochtefeld et al.

(10) Patent No.: US 8,496,403 B2
(45) Date of Patent: Jul. 30, 2013

(54) WAVE POOL WITH MOVING REEF WAVE GENERATOR EXTENSION AND COUNTER CURRENT

(76) Inventors: Thomas J. Lochtefeld, La Jolla, CA (US); Charles E. Sauerbier, Arroyo Grande, CA (US)

( * ) Notice: Subject to any disclaimer, the term of this patent is extended or adjusted under 35 U.S.C. 154(b) by 142 days.

(21) Appl. No.: 12/455,107

(22) Filed: May 28, 2009

(65) Prior Publication Data

US 2010/0000014 A1 Jan. 7, 2010

Related U.S. Application Data

(60) Provisional application No. 61/130,053, filed on May 28, 2008.

(51) Int. Cl.
*E02B 3/00* (2006.01)

(52) U.S. Cl.
USPC ..... 405/79; 472/128; 4/491

(58) Field of Classification Search
USPC ..... 405/79; 472/128; 366/136, 137, 366/332–335
See application file for complete search history.

(56) References Cited

U.S. PATENT DOCUMENTS

| | | | | |
|---|---|---|---|---|
| 586,983 | A * | 7/1897 | Wharton, Jr. | 4/491 |
| 2,064,035 | A | 12/1936 | Rynearson | |
| 3,005,207 | A | 10/1961 | Matrai | |
| 3,398,948 | A * | 8/1968 | Grisham | 405/79 |
| 3,473,334 | A | 10/1969 | Dexter | |
| 3,557,559 | A * | 1/1971 | Barr | 405/79 |
| 3,562,823 | A | 2/1971 | Koster | |
| 3,789,612 | A | 2/1974 | Richard et al. | |
| 3,802,697 | A | 4/1974 | Le Mehaute | |
| 3,851,476 | A | 12/1974 | Edwards | |
| 3,913,332 | A | 10/1975 | Forsman | |
| 4,522,535 | A | 6/1985 | Bastenhof | |
| 4,662,781 | A | 5/1987 | Tinkler | |
| 4,792,260 | A | 12/1988 | Sauerbier | |
| 4,954,014 | A | 9/1990 | Sauerbier et al. | |
| 5,000,110 | A | 3/1991 | Moore | |
| 5,171,101 | A | 12/1992 | Sauerbier et al. | |
| 5,342,145 | A | 8/1994 | Cohen | |
| 5,664,910 | A | 9/1997 | Lochtefeld et al. | |

(Continued)

FOREIGN PATENT DOCUMENTS

| | | |
|---|---|---|
| FR | 1.019.527 | 1/1953 |
| JP | 52-41392 | 3/1977 |
| JP | S54-118630 A | 9/1979 |

*Primary Examiner* — Sean Andrish
(74) *Attorney, Agent, or Firm* — J. John Shimazaki

(57) ABSTRACT

The invention relates to a wave pool with a beach having a body of water and a wave generator that travels along a relatively shallow channel across from the beach. The wave generator is adapted to travel through the channel and displace the water in the channel to create primary waves on which surfing maneuvers can be performed. The primary waves in turn enter into the body of water to produce secondary waves that can be acted upon by the inclined pool floor so that they eventually break and spill onto the beach. The water in the channel is preferably provided with a reverse current to enable the absolute speed of the wave generator to be reduced, which allows the channel to be shorter in length without significantly impacting the wave effects that are created, which helps reduce the cost of construction. The wave generator is preferably provided with a forward extending wing section that causes the leading edge to extend further out in front of the flow forming surface, which provides added safety to the participants.

28 Claims, 13 Drawing Sheets

U.S. PATENT DOCUMENTS

| | | | |
|---|---|---|---|
| 5,766,082 | A | 6/1998 | Lochtefeld et al. |
| 5,860,766 | A | 1/1999 | Lochtefeld et al. |
| 5,911,190 | A | 6/1999 | Lochtefeld et al. |
| 6,105,527 | A | 8/2000 | Lochtefeld et al. |
| 6,336,771 | B1 | 1/2002 | Hill |
| 6,460,201 | B1 | 10/2002 | Lochtefeld |
| 6,928,670 | B2 | 8/2005 | Lochtefeld et al. |
| 2010/0017951 | A1 | 1/2010 | Sagastume |

* cited by examiner

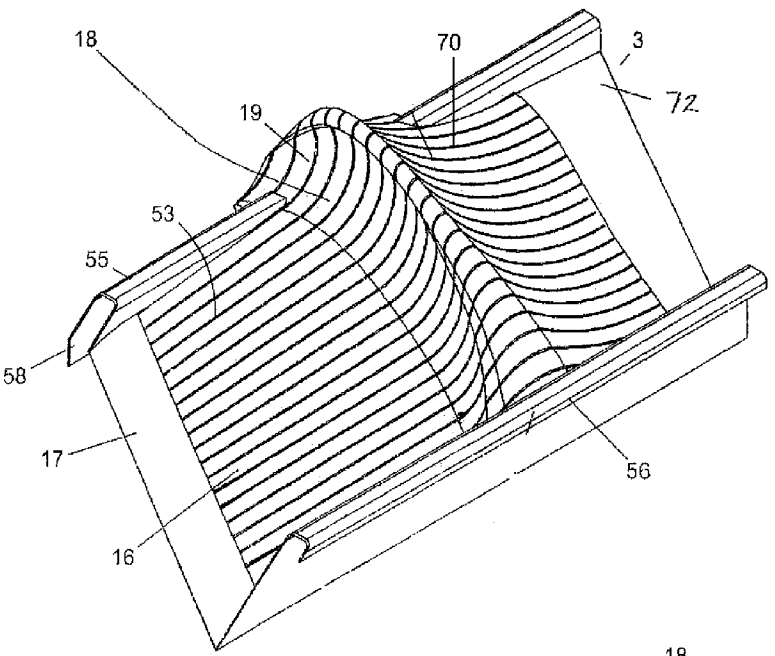
FIG 9
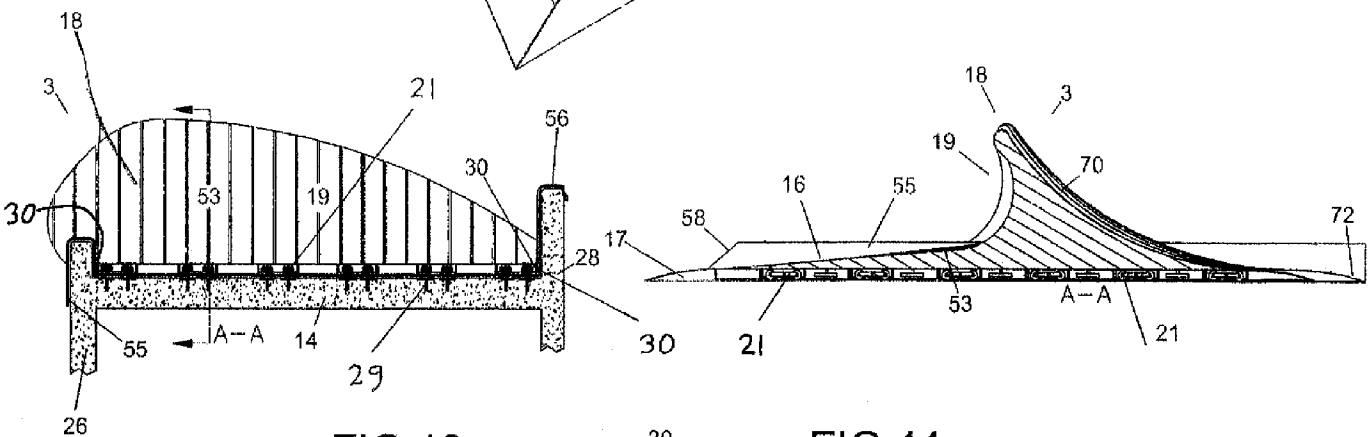
FIG 11
FIG 10
30

WAVE POOL WITH MOVING REEF WAVE GENERATOR EXTENSION AND COUNTER CURRENT

RELATED APPLICATION

This application claims the benefit of the filing date of U.S. Provisional Application Ser. No. 61/130,053, which was filed on May 28, 2008.

FIELD OF THE INVENTION

The present invention relates to a wave pool, and in particular, a wave pool having a wave generator that travels through a channel separated from an adjacent body of water, wherein primary waves are created by the wave generator, and secondary soliton waves are created within the body of water, wherein the channel can be adapted with a counter current that allows the wave generator to travel at a lower absolute speed, for a longer duration, while maintaining substantially the same net speed relative to the current, and wherein the wave generator is adapted to provide additional safety to the participants.

BACKGROUND OF THE INVENTION

An attraction that has become popular at water theme parks throughout the country is the wave pool. Wave pools are typically man-made bodies of water wherein a wave generator is located at one end of the pool, and a simulated beach is located at the other end, wherein waves created by the wave generator travel across the pool and break onto the beach. In particular, attempts have been made to create spilling, breaking waves, using mechanical wave generators that are designed to push substantial amounts of water back and forth in the pool. This movement is typically created at the deep end of the pool and involves creating waves that travel toward the opposite shallower end where the waves eventually break. These generators are often driven by motors, such as those that are mechanically, pneumatically, or hydraulically operated.

One of the main shortcomings of conventional wave pool designs, however, is that the size of the waves is often a function of the distance that the waves have to travel through the pool, wherein each wave must travel a distance sufficient to allow the inclination of the pool floor to act upon the wave, to create spilling, curling or breaking wave formations therein. For this reason, in many cases, previous wave pool designs have been relatively large, i.e., the distance from one end of the pool (where the generator is located) to the opposite end (where the beach is located) was sufficient to allow the waves to not only form but also break along the beach. Accordingly, past wave pools required large footprints which increased the cost of construction both in terms of buying the land on which the wave pool is built and building the wave pool.

In response to these drawbacks, Applicants previously developed a new wave generating system that was the subject of U.S. Pat. No. 6,928,670, which is incorporated herein by reference. In that invention, the amount of throughput and usable space provided by the wave pool was increased, and various wave formations on which water skimming and surfing maneuvers could safely be performed were produced. In one aspect, the previous wave generator was adapted to travel along the surface of the body of water, from one end of the wave pool to the other, to create primary wave formations thereon. It also produced secondary waves that traveled outwardly from the wave generator from a relatively deep water environment to a relatively shallow water environment where the waves could eventually break along the shore.

The wave generator itself was configured to travel along the surface of the body of water and had wave forming surfaces on top that were adapted to act upon the water in a manner that caused the water to be lifted up and flow upward and laterally outward, thereby forming primary wave shapes thereon. Several suitable wave generator hull shapes that could be used in connection with the previous invention as well as this one were disclosed in U.S. Pat. Nos. 6,105,527; 5,911,190; 5,860,766; 5,664,910, which are incorporated herein by reference. The wave generator was preferably buoyant so that it could float and be pulled by a cable or other means along the surface of the water. The wave generator was also preferably supported by an extension that extended up from a submerged trolley and track system extended on the pool floor, wherein the trolley was adapted to slide or roll on the track as it was being pushed or pulled through the water to create various wave forms and characteristics.

In this respect, the previous wave generator was able to create both primary and secondary waves that traveled outwardly toward opposite sides of the shore. The primary waves were created directly by the wave generator itself and in close proximity thereto, such as directly on or in front of the wave generator, and in some cases, laterally to the side, as the wave generator traveled through the water. The displacement of water created by the wave generator as it traveled through the water also helped to create a multiplicity of secondary waves that resulted from the movement of the wave generator through the water. Analogous to a boat or displacement hull moving through a body of water, the wave generator created a bow wave, a stern wave and a series of transverse waves. This multiplicity of secondary wave formations resulted from the displaced water being repositioned and spilled into the surrounding body of water to create a series of moving swells that eventually transformed into a train of waves that traveled toward the shoreline and broke upon the beach.

The primary waves created by the previous wave generator were capable of being generated in a relatively deep water environment unaffected by the depth of the pool floor, whereas, the secondary waves that were created behaved much like regular ocean waves, and therefore, were subject to the influences of the pool floor, including the depth, slope and topography thereof. As the secondary waves traveled toward the shoreline, how they formed, developed, and broke, were significantly affected by the character of the pool floor which determined the nature of the waves that eventually broke along the beach.

By virtue of creating waves in this manner, the previous invention was able to provide multiple wave effect zones within the wave pool, i.e., one participant could be riding on the primary wave generated by the wave generator in a relatively deep water environment while another participant could be riding on the secondary waves traveling and breaking toward the relatively shallow shore at the same time.

One of the main drawbacks of the previous design, however, was the amount of land that was required to build the wave pool due to the factors discussed above.

A second drawback was the increased hazard that existed as a result of having to move a large wave generator hull along the surface of a body of water through a relatively deep water environment, wherein participants in the water were then subject to being lost from sight such as if they fell under the device as the wave generator passed by.

A third drawback was the multiplicity of secondary waves that resulted in a boat wake wave-train formation. The first wave of this train of waves was usable. However, the subsequent waves in the train were inferior due to turbulence from the prior breaking wave. Additionally, to the extent not properly used, each subsequent wave in the train represented wasted energy that would be better focused in a single wave phenomenon.

What is needed, therefore, is an improved wave pool design which allows the wave pool to be made relatively small, and safe, and would allow the wave generator to travel along the surface to create a primary wave and a secondary solitary wave both suitable for surfing.

SUMMARY OF THE INVENTION

The wave pool of the present invention generally comprises a wave pool through which waves and water effects can travel. The main portion of the wave pool preferably has a relatively deep water environment on one end and a relatively shallow water environment with a sloped beach at the opposite end, with an inclined floor extending in between. But unlike the previous invention, it also preferably comprises a wave generator that can travel along a relatively shallow channel of water located atop a plateau adjacent the deep end of the wave pool, wherein the wave generator has flow forming surfaces on top with curvatures sufficient to cause the water in the channel to be displaced upward and laterally outward to produce primary waves and then as a by-product secondary waves in the wave pool adjacent thereto. In this respect, the wave generator is preferably adapted to displace the water in the channel and generate energy in a manner that generates the primary wave(s), which in turn, help to generate a solitary disturbance that produces the secondary wave(s), which travel toward the relatively shallow shoreline to create additional curling, spilling or breaking wave(s) thereon.

The wave generator preferably travels along a relatively shallow channel of water rather than a relatively deep water environment as in the previous design. The term "shallow" as used and understood herein will be defined in more detail below. The top surface of the channel is preferably smooth and has a track thereon that supports the wave generator as it travels through it, wherein the wave generator does not have to be buoyant or float as in the previous design. Rather, it preferably travels only about an inch or so above the top surface of the channel, wherein by controlling the depth of the body of water within the channel, and how close the wave generator's leading edge travels relative to the top surface, the thickness of the sheet flow of water lifted and acted upon by the flow forming surface to generate the primary waves can be carefully controlled.

The channel preferably comprises its own body of water with a divider wall that extends substantially between the main wave pool's body of water and the channel's body of water. This way, any water effects created within the main wave pool will not adversely affect or interfere with the desired water effects created within the channel. Likewise, except the secondary waves that are intentionally created within the wave pool, the water effects created within the channel will not otherwise affect or interfere with the water effects within the wave pool. Because of the dividing wall, the level of the water within the channel can also be adjusted without having to adjust the level of the water in the wave pool and vice verse.

The channel is preferably raised on a plateau relative to the deep water environment immediately adjacent to it, thereby creating a drop off area immediately next to the channel which enhances secondary wave generation in the wave pool. This enhancement results from eliminating multiple wave disturbances (e.g., bow wave, stern wave and transverse waves, such as in the previous design) that are created from the movement of the wave generating assembly as it traverses through the channel. Preferentially, it enables a soliton wave phenomenon to be created, i.e., a solitary wave that enters and travels through the relatively deep water environment and enters into the relatively shallower incline sloped area of the floor before approaching the shallow shoreline and breaking along the beach.

In the preferred embodiment, the body of water within the channel is adapted to flow in a direction opposite the travel direction of the wave generator. The present invention contemplates that means, such as screw or propeller pumps, nozzles, jets, etc., can be used to cause the body of water within the channel to flow in a reverse direction relative to the wave generator, such that as the wave generator travels through the channel, the water flows against it. This reverse flow is preferably separated from the wave pool's body of water by the divider wall that extends between the channel and main wave pool. Nevertheless, the divider wall is preferably low enough so that the primary waves produced by the wave generator can pass freely over the divider wall in a relatively smooth manner such that it can form the secondary waves in the wave pool.

In one embodiment, the divider wall can be slightly below the mean water level in the wave pool such that after the wave generator passes through the channel, water in the wave pool will tend to flow back into the channel as the water seeks its own level. In another embodiment, the divider wall can be slightly higher than the mean water level in the wave pool, wherein it can be seen that the water in the channel can then be at the same level as, or above or below, the mean level of the water in the wave pool. When the level of the water in the channel is above the mean level of the water in the wave pool, additional energy can be introduced into the wave pool by virtue of the water used to produce the secondary waves originating at a slightly higher elevation, i.e., with greater potential energy.

In reference to the performance characteristics of the waves, it has been discovered that for a wave generator of this kind to create waves of adequate size and shape suitable for surfing, the wave generator would have to travel at a speed of about 15 to 25 feet per second (about 4.57 to 7.62 meters per second) relative to the surrounding water, with the preferred speed being 22 feet per second (15 miles per hour or about 6.71 meters per second). It has also been determined that the wave generator in such case would have to travel for about 15 seconds to not only propagate the waves properly, but also to enable the participants riding on the water ride to enjoy the experience. This is an estimate given that the duration would also have to take into account the wave generator's acceleration, and how quickly it can accelerate to the preferred speed. Based on this assumption, however, and by way of example, the channel of a typical wave pool would probably have to be built at least 330 feet (about 100.58 meters) in length to allow the wave generator to travel at 22 feet per second (about 6.71 meters) for about 15 seconds (without taking into account acceleration and wave formation time). If the wave pool was made any smaller than that, either the duration of the ride, or the speed at which the wave generator travels through the water, would have to be reduced.

The present invention comprises an improvement over previous designs by producing a counter current in the channel through which the wave generator travels that enables the absolute speed at which the wave generator travels relative to the surrounding channel to be reduced, while at the same time, substantially maintaining the net speed at which the wave generator travels through the surrounding current of water. That is, by providing a reverse current in the channel, even if the absolute speed of the wave generator relative to the surrounding channel is reduced, the net speed at which the wave generator travels through the current can be maintained substantially the same. For example, if the water flows at a speed of 7 feet per second (about 2.13 meters per second) in the opposite direction, then, for the wave generator to achieve a net effective speed of 22 feet per second (about 6.71 meters per second), the absolute speed that the wave generator has to travel can be reduced by 7 feet per second (about 2.13 meters per second), to 15 feet per second (about 4.57 meters per second), without substantially impacting the wave effects created thereby.

This not only allows the wave generator to travel at a reduced absolute speed, which has its own benefits such as lower operating costs, but it also allows the wave generator to operate at that speed for a longer period of time as it makes its way across the channel without increasing the size of the pool or channel. The net effect is that the wave generator can create substantially the same water effects and wave formations for a longer period of time within the same size pool. Likewise, what this means is that the pool size can also be decreased without substantially impacting the nature and character of the water effects and wave formations that are created by the wave generator, or the duration of the ride time. That is, by incorporating the reverse current technology, and reducing the absolute speed of the wave generator relative to the surrounding land, substantially the same water effects and wave formations can be produced within a smaller wave pool.

For instance, the same wave pool with a channel that had to be 330 feet (about 100.58 meters) long to enable the wave generator to travel at the desired speed for the desired amount of time could then be reduced in size, while still producing substantially the same water effects and wave formations for substantially the same amount of time. That is, a channel that is only about 225 feet long (about 68.58 meters) can create a reverse flow of 7 feet per second (about 2.13 meters per second) and by reducing the absolute speed of the wave generator from 22 feet per second (about 6.71 meters per second) to 15 feet per second (about 4.57 meters per second), substantially the same water effects and wave formations can be created.

Another notable feature of the present invention is that although the absolute speed of the wave generator relative to the surrounding channel can be reduced, the secondary waves created as a byproduct of creating the primary waves can nevertheless be produced without substantial alteration, i.e., they can be produced in substantially the same size and shape as before. That is, even if the absolute speed of the wave generator is reduced, because the net speed of the wave generator relative to the water remains unchanged, the net energy and water effects created by the wave generator relative to the current of water in the channel will not be significantly reduced or altered. Rather, the energy created by the wave generator in the form of primary waves will enter into the wave pool with substantially the same force and effect, except at a reduced speed, thereby resulting in the formation of secondary waves having substantially the same size and shape as those generated by the previous wave generator design.

Typically speaking, to create the primary waves, water must be lifted up by the leading edge of the wave generator as it passes through the water wherein the flow of water created will begin as a sheet flow of water that travels over the forward leading edge of the wave generator, and, depending on the depth of the water in the channel, the sheet flow created by the wave generator (in a shallow flow and high Froude number regime of a few inches deep and moving at 20+ feet per second) will be more or less akin to the type of flow created by Applicant's Flow Rider™ invention (except that in this instance both the water and flow forming surface are moving relative to each other). For example, when the sheet flow is relatively shallow, such as up to about nine inches in depth and moving in excess of 20+ feet per second, the sheet flow created by the wave generator generally has a substantially consistent shape and depth as it flows over and across the flow forming surface with a height of 5 feet, wherein the wave formations take on substantially the same shape as the flow forming surface that supports it. This will occur at least until the water becomes airborne at the edge or peak of the flow forming surface, wherein the water will then be released from the boundary layer supporting it, to form a trajectory that travels laterally up and/or down into the wave pool to create the secondary waves.

In such case, any pressure disturbance created by a rider on a surfboard on the riding surface will typically be influenced by the resistance created by the boundary layer through a reaction force generally known as the "ground effect," wherein the pressure field between the surfboard and the ride surface is allowed to participate in supporting the weight of the rider/board. This can occur without the pressure disturbance created by the board being diminished before it comes into contact with the boundary.

On the other hand, when the sheet flow is relatively deep, such as between about nine inches to eighteen inches, or more, within a low Froude number regime, although the sheet flow may start out relatively consistent in size and shape near the front of the wave generator, once the water encounters the inclined portion of the wave generator, the water will begin to build up, causing the water to layer on top of itself, both vertically and horizontally, to cause the depth of the water across the inclined portion to increase. At this point, the kinetic energy of the wave formation will begin to exceed its potential energy and water will begin to pile up and form a hydraulic jump that will typically spill over and collapse laterally sideways toward the wave pool. The increased depth of the water flow in this case will in turn create a thickening of the water on the inclined portion of the ride surface, wherein, analogous to a wave breaking in a river when caused by a sub-surface rock, the Froude number will fall below "1.0" and a breaking wave will form.

Because the shape of the wave formation is a function of the speed of the wave generator, even with a deeper flow, if the speed of the wave generator is significant enough, the shape and depth of the sheet flow could potentially be consistent across the face of the riding surface. Nevertheless, given the speeds contemplated by the present invention, when the channel depth is increased, the wave formations that are created by the wave generator are likely to be increasingly thickened toward the inclined portion of the flow forming surface. When the depth of the water flowing in the channel is higher, i.e., up to about three feet deep, the water will tend to build up even more quickly, causing the wave formation to collapse onto itself, so that as the water is forced up the incline, its speed and momentum are unable to support the weight of the water above it, and the water will then tend to spill over sideways and collapse laterally backward toward the area of least resistance, which is the wave pool.

The energy and momentum created by the primary wave flowing over and across the wave generator and into the wave pool is what creates the secondary waves. Water is essentially scooped up by the wave generator and "tossed" sideways and released into the wave pool, wherein the energy and momentum created thereby causes the water entering into the wave pool to create a relatively isolated surface disturbance that generates the swell that forms the secondary waves. In this respect, it is important to note that unlike the previous design, the disturbance point created by the primary waves in this instance is relatively isolated, i.e., the point at which the water and wave energy enters into the wave pool does not extend along the length of the wave generator, and the length of the generator does not create a bow wave, a stern wave and a series of transverse waves, as in the case of the previous design. Rather, in the present invention, it is the relatively isolated energy and momentum created by a single primary wave that enters into the wave pool at a relatively isolated location (at any given point in time) that causes water and energy to spill into the wave pool to create the various motions, harmonics, and dynamics that occur simultaneously to create what eventually becomes the secondary wave.

Nevertheless, as the wave generator travels and moves forward through the channel, this disturbance point moves longitudinally through the wave pool thereby causing the origin point of the secondary wave to move longitudinally along the length of the channel. Even though the disturbance point itself is isolated, because the wave generator is moving relative to the wave pool at a predetermined speed, the secondary wave that it creates is extended and stretched longitudinally, so that the origination point constantly changes as the wave generator moves forward. What this does is create a single and continuous secondary wave that flows from the channel and into the wave pool and then across the wave pool toward the beach.

By changing the absolute speed of the wave generator, however, the angle at which the secondary waves travel across the wave pool and toward the shoreline can be adjusted. This occurs because the angle at which the secondary waves travel relative to the channel will depend on how fast the wave generator travels through the channel, i.e., its absolute speed, not relative speed. For example, if the absolute speed of the wave generator is zero, the disturbance point will remain substantially stationary, and therefore, the secondary waves would just spread out from a central point much like a ripple in a pond. On the other hand, when the absolute speed of the wave generator is increased, the creation and disturbance point of the secondary wave will be stretched longitudinally across the length of the channel, wherein the secondary waves will then tend to flow more parallel to the channel and therefore more parallel to the shoreline across from it. What this means is that by adjusting the absolute speed of the wave generator relative to the channel, the secondary waves can be made to flow more transverse to the shoreline by slowing it down, or more parallel to the shoreline by speeding it up, and, in the present invention, various wave formations and angles within the wave pool can be created simply by making these adjustments.

The channel is preferably constructed on a plateau that extends over a return culvert wherein the culvert preferably extends underneath the channel to allow the water to be drawn down through a grate on one end and circulated back to the opposite end where the nozzles that inject the water onto the channel are located. In one embodiment, the pump that generates the movement of the water through the channel and culvert can be located at the opposite end of the channel from where the nozzles are located. That is, while the nozzles that inject water onto the channel can be located at one end of the channel, the pump used to increase the pressure of the water within the return culvert can be located at the opposite end, which gives the turbulence caused by the pump more time to subside before the water is released through the nozzle. In another embodiment, the pump can be located immediately underneath and adjacent to the nozzles. A grate is preferably provided at the suction end to allow water to pass through and into the return culvert while providing a measure of safety to the participants above.

Another notable feature of the present system is that the wave generator is preferably constructed with a horizontally extended forward wing section that places the forward leading edge of the wave generator further out in front of the flow forming surface of the hull (the 'reef') when compared to the previous design, i.e., by about two to three surf board lengths in front in the flow forming surface. This forward wing section is preferably extended substantially horizontally across the entire front portion of the wave generator, such as at an angle relative to the channel in plan view. One advantage of this configuration is that it causes the leading edge of the wave generator to extend far enough in front of the wave forming surface, such that as the wave generator moves forward, a measure of safety is provided by reducing the risk that a participant riding on the wing section or otherwise in front of the wave generator could fall and be drawn underneath. This configuration also allows water to be lifted up and form a sheet flow that extends up the inclined portion that enables participants to maneuver on the wing section, wherein water skimming and surfing maneuvers can be performed thereon, such as directly in front of the wave forming surface, and/or slightly to the side of it, as the wave generator travels forward through the channel.

Also, by keeping the leading edge of the wing section substantially low relative to the top surface of the channel—less than three inches and preferably about one inch—the amount of water that can be lifted and pared up from the body of water in the channel and onto the wave forming surface can be maximized. Because the thickness of the sheet flow of water lifted by the wave generator is substantially determined by the depth of the channel's body of water, and how low the leading edge travels relative to the top surface, keeping the leading edge low helps to ensure that the thickest possible sheet flow of water is produced per unit of energy expended to propel the water in the channel forward.

Nevertheless, it has been found that the leading edge should not be too close to the top surface of the channel, i.e., there should be some space between the two surfaces. This is because if water is not allowed to pass underneath the wave generator, a suction force would then be created which would create an adverse pressure point that could cause the wave generator to slow down or even become stuck to the channel due to the downward pressure exerted against the wave generator. The preferred water depth to pass underneath the wave generator has been found to be about one inch. The bottom surface of the wave generator is also preferably made smooth and extended laterally and adapted so that no additional pressure points are created under the wave generator that could negatively affect the movement of the wave generator through the channel.

To help ensure that the wave generator travels smoothly with little or no restriction through the channel a series of rollers are preferably provided underneath the wave generator that roll freely on the top surface of the channel. The top surface is preferably smooth and horizontally oriented so that the rollers can travel freely from one end of the channel to the other. Several side rollers are also preferably provided on the sides of the wave generator such as abutted against the channel side walls to keep the wave generator traveling straight.

A cable is preferably connected to the front of the wave generator to pull the wave generator through the channel in one direction. The cable is preferably driven by a drive mechanism and pulley system in a conventional manner although any means can be devised and is contemplated by the present invention. The cable is preferably connected near the middle of the wave generator to help keep the pressure and forces acting on the wave generator substantially symmetrical about the connection point, thereby helping to keep the wave generator moving consistently forward. When the wave generator has completed a single run through the channel, the present invention preferably contemplates allowing the cable to be released and the wave generator to be moved through the channel in the opposite direction by the momentum of the water flowing through the channel. That is, once the wave generator has finished its run, the water flowing through the channel preferably causes the wave generator to roll back in the opposite direction, until it reaches the opposite end, wherein the cable can be re-connected and re-used to drive the wave generator back through the channel to create additional waves. This is preferably done so that the system does not have to utilize a separate mechanical device to pull or push the wave generator back the other way. Alternatively, in a static water environment, or, in order to speed the return of the wave generator in a reverse current set-up, a return cable and drive mechanism can be used to pull the device back to its start point.

Another safety feature of the present invention is that there is preferably a grated surface that extends around the periphery of the wave pool on or near the sloped portion of the beach such that residual water and wave energy can be removed to dampen the waves that travel and break along the shoreline. That is, as the waves break and crash onto the beach, the water and wave energy are preferably allowed to pass through the floor through the grate, so that adverse water movements and effects resulting from the waves, such as rip currents flowing back down the slope of the beach, or other wave reflections, can be reduced or eliminated. In this respect, the dampening system described in U.S. Pat. No. 6,460,201, or in U.S. Application Ser. No. 61/200,183, filed on Nov. 25, 2008, which are incorporated herein by reference, are illustrative of the kinds that can be used in connection with the present invention.

Additional benefits and advantages of the present invention will be discussed and become evident from the following detailed description.

BRIEF DESCRIPTION OF THE DRAWINGS

FIG. 9 is an isometric view of the wave generator hull showing the contours of the riding surface, including the forward leading edge, the extended wing section, and the flow forming surface and curved structure on the hull;

FIG. 10 is a cross section taken across the wave generator hull showing the contours of the hull, the rollers and the configuration of the support edges on either side, as well as the channel structure showing the divider wall and outer support wall that form the track through which the wave generator travels;

FIG. 11 is a cross section taken along the length of the wave generator hull assembly showing the forward leading edge, the extended wing section, the flow forming surface, the curved structure on the hull, and the rollers underneath;

DETAILED DESCRIPTION OF THE INVENTION

Figure 1:
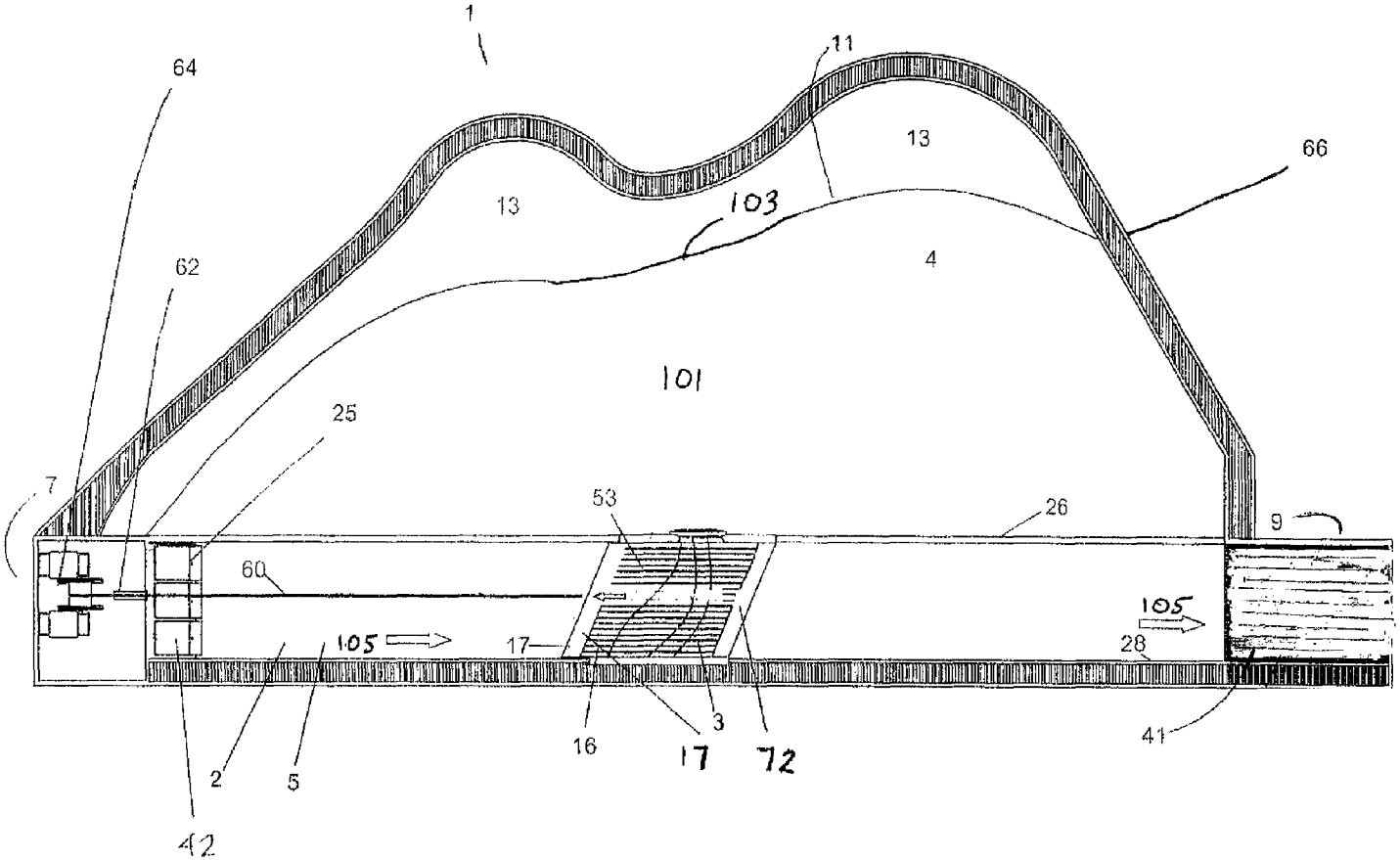
FIG. 1 is a plan view of an embodiment of the present invention showing the channel through which the wave generator travels as well as the wave pool with a shoreline thereon.

FIG. 1 shows an overall plan view of an embodiment of the present invention showing a wave pool 1 with a first body of water 4 therein and a shoreline 11 with a beach 13 generally extended along one side. Shoreline 11 can be created in virtually any configuration and preferably comprises an inclined beach 13 upon which the secondary waves 6 shown in FIG. 13, which are created by wave generator 3, can break, along with a secondary wave reform area 101 and secondary wave surf area 103. Preferably, beach surface 13 is inclined and formed like a traditional sand beach or can be made artificially with a padded or otherwise resilient surface to provide a measure of safety to participants.

Figure 2:
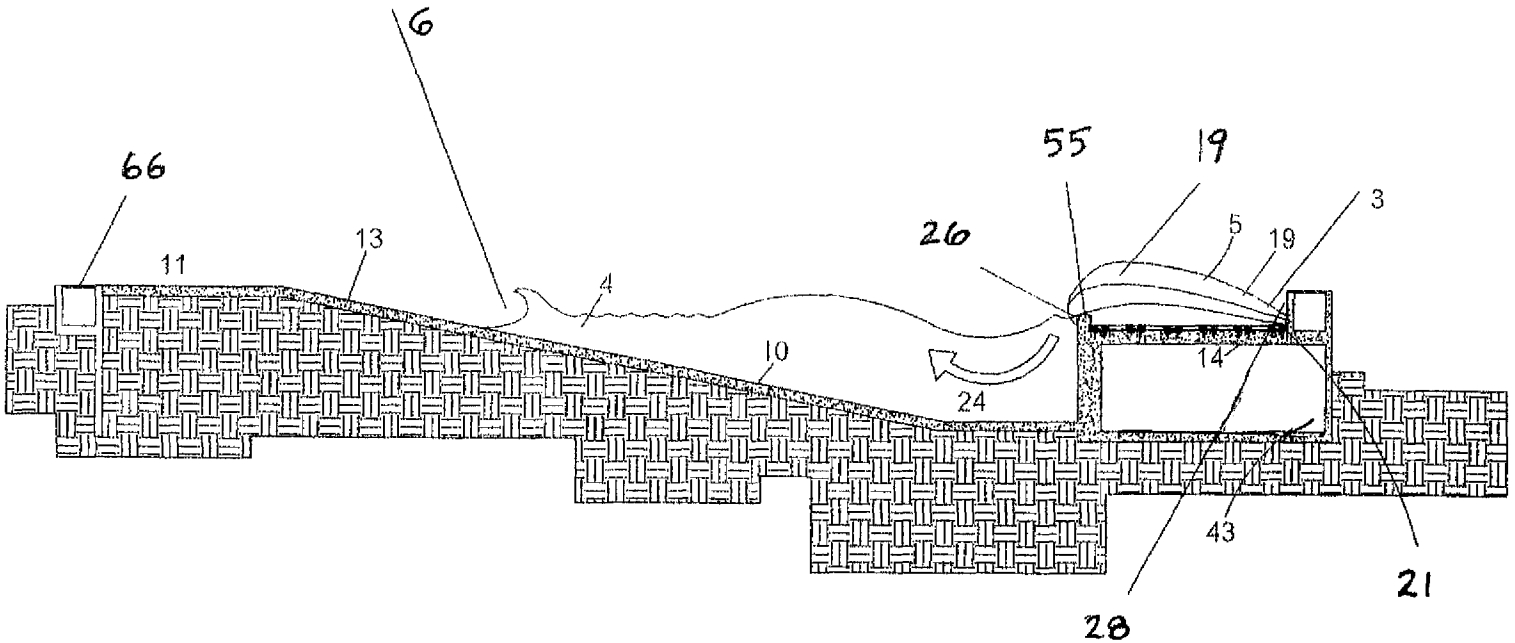
FIG. 2 is a typical cross section of the wave pool of FIG. 1 taken transverse to the direction of the channel, showing the plateau on which the channel is located, and the culvert through which water circulates underneath, as well as an inclined pool floor which acts upon the secondary waves created in the wave pool.

Wave pool 1 is preferably adapted with an inclined floor 10 as shown in FIG. 2 with a relatively deep water environment 24 extended along one side opposite shoreline 11. Preferably, the slope of inclined floor 10 can be sufficient to produce the desired wave effects within wave pool 1, such as within the range of between 1 degree and 20 degrees, with the preferred slope being about 5 degrees. As a technical note, soliton waves generally do not have a trough and do not have a wavelength and therefore can break as a curling wave at up to approximately ½ the slope steepness range (1/30) as opposed to a standard gravity wave, e.g., ocean wave or boat wake (1/15). The entrance point of the primary wave within deep water environment 24 is preferably adjacent to plateau 14 of channel 5. The depth and slope of floor 10 preferably facilitates the formation of secondary waves by helping to augment the transformation of kinetic energy within the moving primary wave to form the unbroken secondary swell that eventually becomes the duly formed secondary soliton wave.

Figure 13:
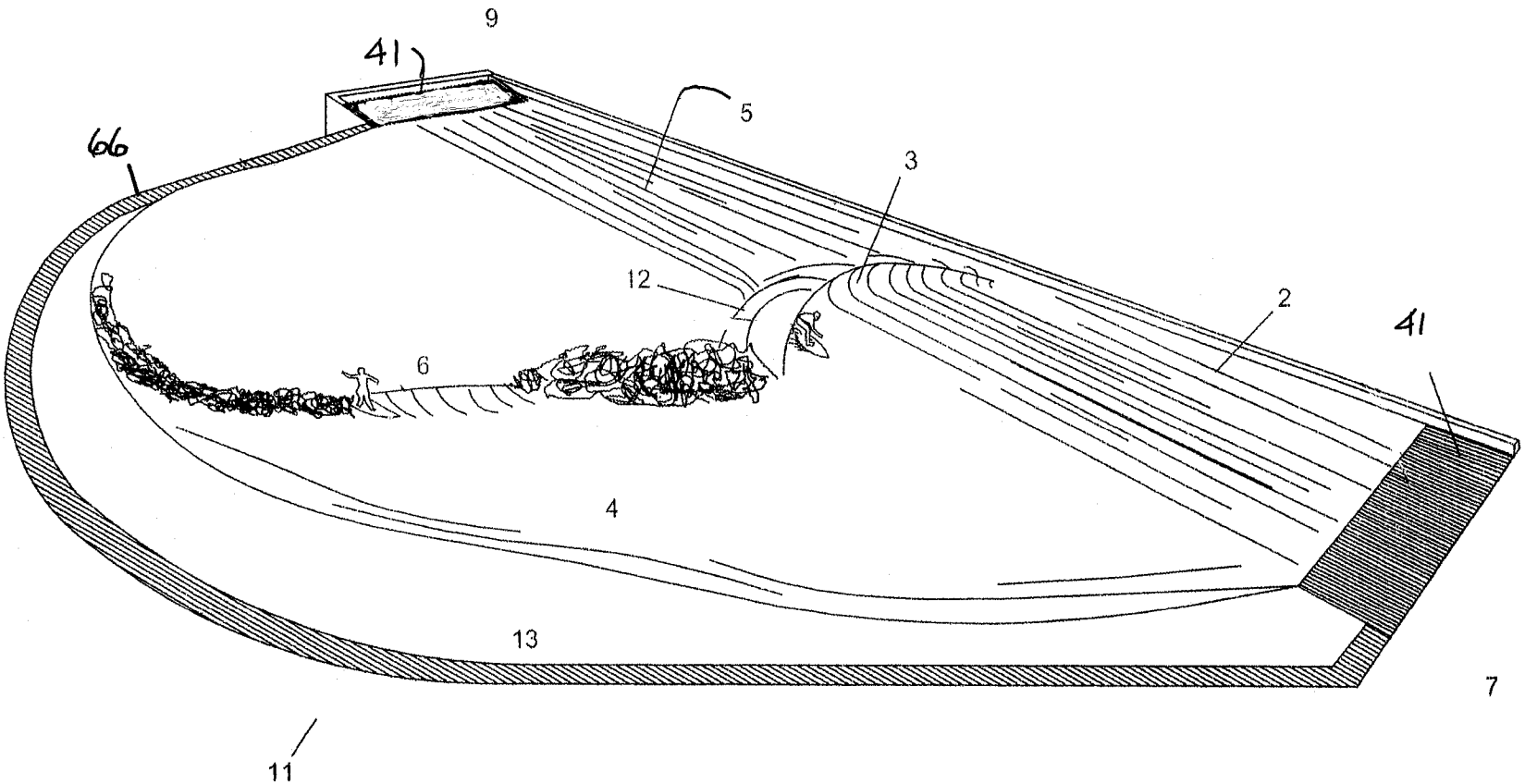
FIG. 13 is a perspective view of the wave pool showing the wave generator traveling through the channel and creating both primary and secondary waves.

On a side opposing beach 13 and located on top of plateau 14 adjacent to deep water environment 24 is preferably a channel 5 extending longitudinally from end 7 to end 9 through which wave generator 3 travels to form primary waves 12 as shown in FIG. 13. Channel 5 preferably extends substantially longitudinally along wave pool 1 such that as wave generator 3 travels through channel 5 to create primary waves 12, secondary waves 6 are formed within deep water environment 24 that travel through body of water 4 and are acted upon by the inclination of pool floor 10 to create spilling, plunging, or breaking waves along beach 13. Channel 5 preferably forms a substantially straight path although virtually any configuration is contemplated.

Wave generator 3 is preferably adapted to travel through channel 5, and while doing so, displace a portion of the body of water 2 within channel 5 wherein primary wave 12 having certain characteristics can be generated thereby. In the preferred embodiment, as seen in FIG. 9, wave generator 3 preferably has a forwardly extended wing section 16 that forms a substantially horizontally oriented platform 53 upon which the flow forming surface 19 of hull 18 of wave generator 3 is situated. As shown in FIG. 1, wing section 16 is preferably extended forward along the entire front edge of wave generator 3 such that it forms a leading edge 17 that extends at an angle relative to the channel direction, which, in the preferred embodiment, can, in plan view, be about 50 to 80 degrees relative to the channel direction with the preferred being about 65 degrees.

In the preferred embodiment, the average distance on hull 18 that extends between leading edge 17 and flow forming surface 19, as shown in FIG. 9, is preferably two to three surf board lengths, or 15 to 25 feet, which not only provides sufficient room for participants to perform skimming and surfing maneuvers thereon, but also causes leading edge 17 to be far enough forward relative to flow forming surface 19 such that leading edge 17 cannot strike or injure participants riding on wave generator 3. Indeed, it has been found that by maintaining the leading edge 17 far enough forward the likelihood that any individual riding on primary wave 12 would be caught underneath wing section 16 in some manner would be substantially eliminated, i.e., even if he or she falls or wipes out on primary wave 12 in front of flow forming surface 19.

Figure 3:
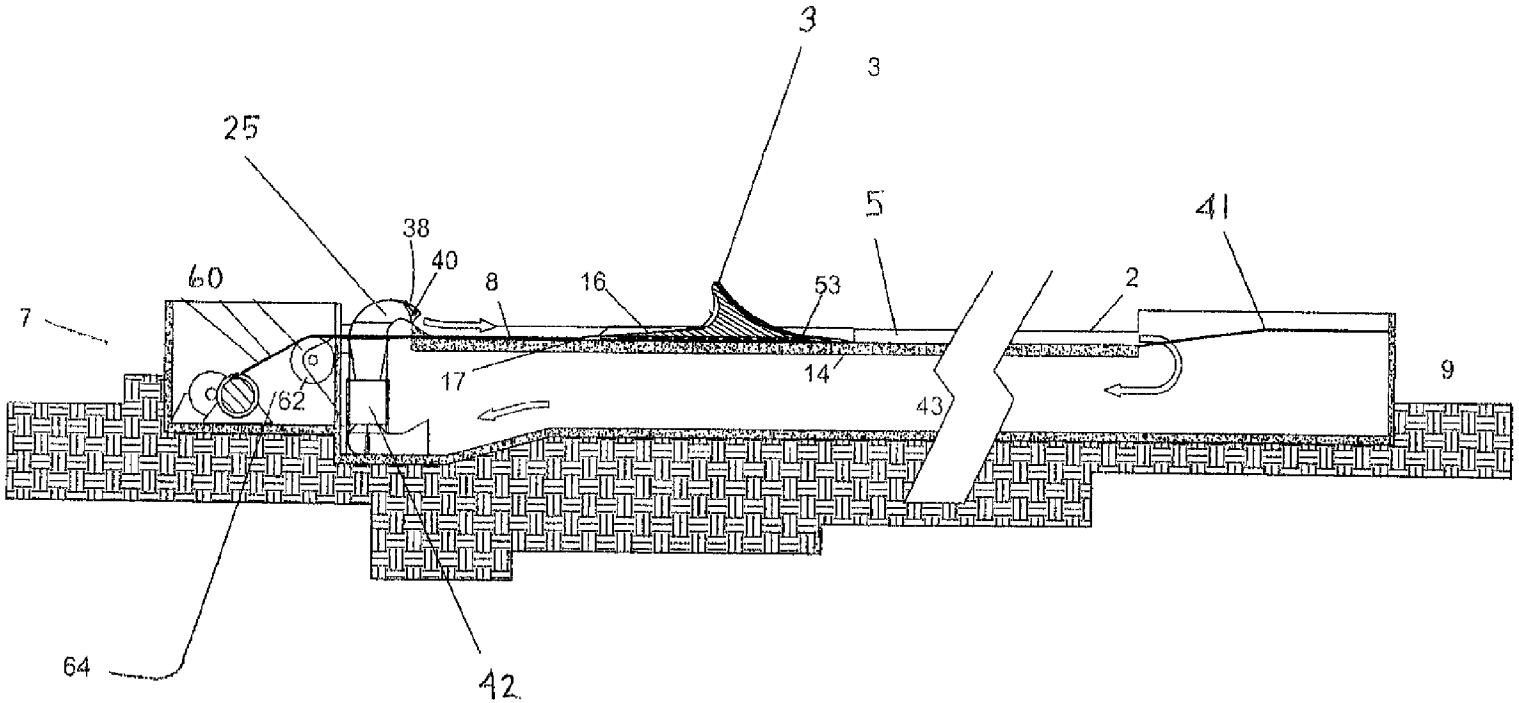
FIG. 3 is a typical cross section taken longitudinally along the length of the channel, showing the plateau on which the wave generator travels, and the culvert underneath the channel, as well as the nozzles and pump on the far left end.

The top surface 8 of channel 5 can be substantially horizontal, as shown in FIG. 3, although not necessarily so, wherein the standing depth of second body of water 2 in channel 5 can be substantially constant. This way, as wave generator 3 travels through channel 5, and leading edge 17 knifes its way through second body of water 2, a substantially constant amount of water can be pared and lifted up onto wave generator 3 to form a consistently shaped sheet flow of water on top of flow forming surface 19 to form primary wave 12. In this respect, the depth of second body of water 2 contemplated by the present invention within channel 5 is preferably between about three inches to three feet relative to top surface 8 depending on the desired characteristics of the waves.

At any given flow depth in channel 5, however, the height at which leading edge 17 travels relative to top surface 8 of channel 5 determines the amount of water and therefore the thickness of the sheet flow of water lifted onto flow forming surface 19. Accordingly, it is important to be able to precisely control not only the depth of second body of water 2, but also the height of leading edge 17 relative to top surface 8 of channel 5. In this respect, underneath wing section 16 there are preferably a series of rollers 21, as shown in FIGS. 10 and 11, which not only allow wave generator 3 to move freely on channel 5, but also allows the vertical position of wave generator 3 and therefore the height of leading edge 17 relative to top surface 8 to be adjusted. In this respect, the level of each roller 21 relative to wing section 16 is preferably made adjustable such that the depth at which leading edge 17 travels relative to top surface 8 can be adjusted and maintained, such as at less than three inches or even one inch.

In this respect, it has been found that leading edge 17 should not be maintained too close to top surface 8 of channel 5, and that there should be at least some space between the two surfaces. This is because if water is not allowed to pass underneath wave generator 3 as it moves forward, a pressure zone would then be created underneath wave generator 3, which would create suction that would cause wave generator 3 to slow down or even become stuck to channel 5 due to the downward pressure exerted against wave generator 3. The preferred water depth that passes underneath wave generator 3 is about one inch give or take. The bottom surface of wave generator 3 is also preferably smooth and laterally adapted so that no additional pressure points are created that could negatively impact the movement of wave generator 3 through channel 5.

A divider wall 26 is preferably extended longitudinally along the edge of channel 5, located between first body of water 4 and second body of water 2. Divider wall 26 preferably helps to maintain the level of the second body of water 2 within channel 5 independently from the level of the first body of water 4 within wave pool 1. Divider wall 26 also serves to enable the amount of water being lifted by wave generator 3 as it passes through channel 5 to be independently adjusted without having to adjust the level of first body of water 4. It also provides a supporting edge along which, in conjunction with outer wall 28 extended on the opposite side of channel 5, forms a track 29 through which wave generator 3 can travel and be guided through without shifting substantially from side to side. Channel 5 and plateau 14, as well as wave pool 1, can be made using conventional concrete, wherein track 29 preferably comprises steel imbedded into concrete to form a smooth top surface 8 on channel 5 as shown in FIG. 10.

Figure 4B:
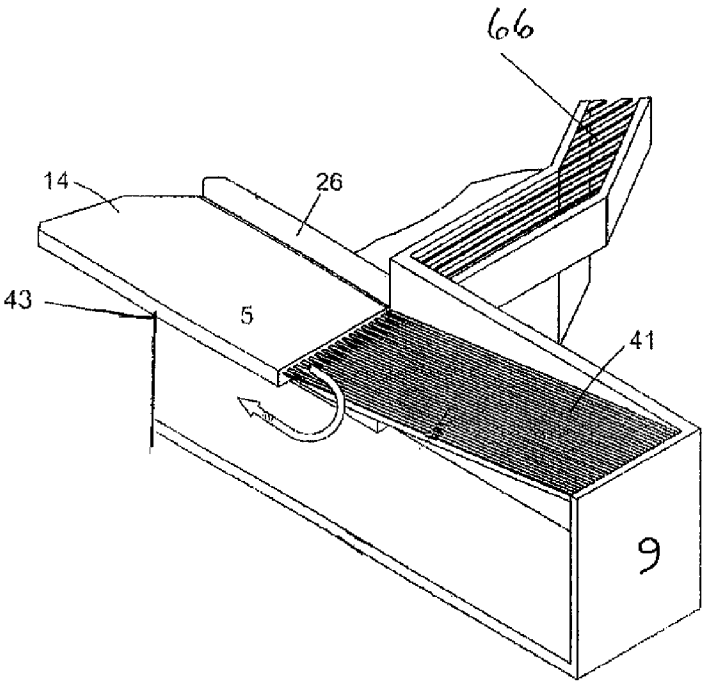
FIGS. 4*a* and 4*b* are details of the grating assembly located at the suction end of the channel where the water in the channel is drawn down into the culvert below.
Figure 4A:
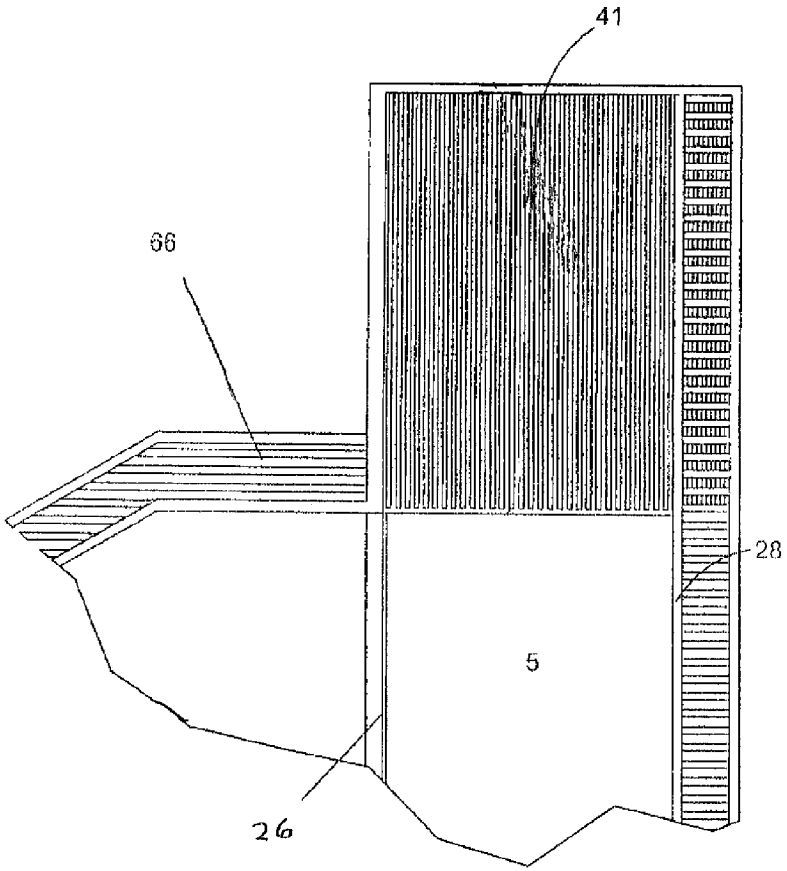
Figure 6:
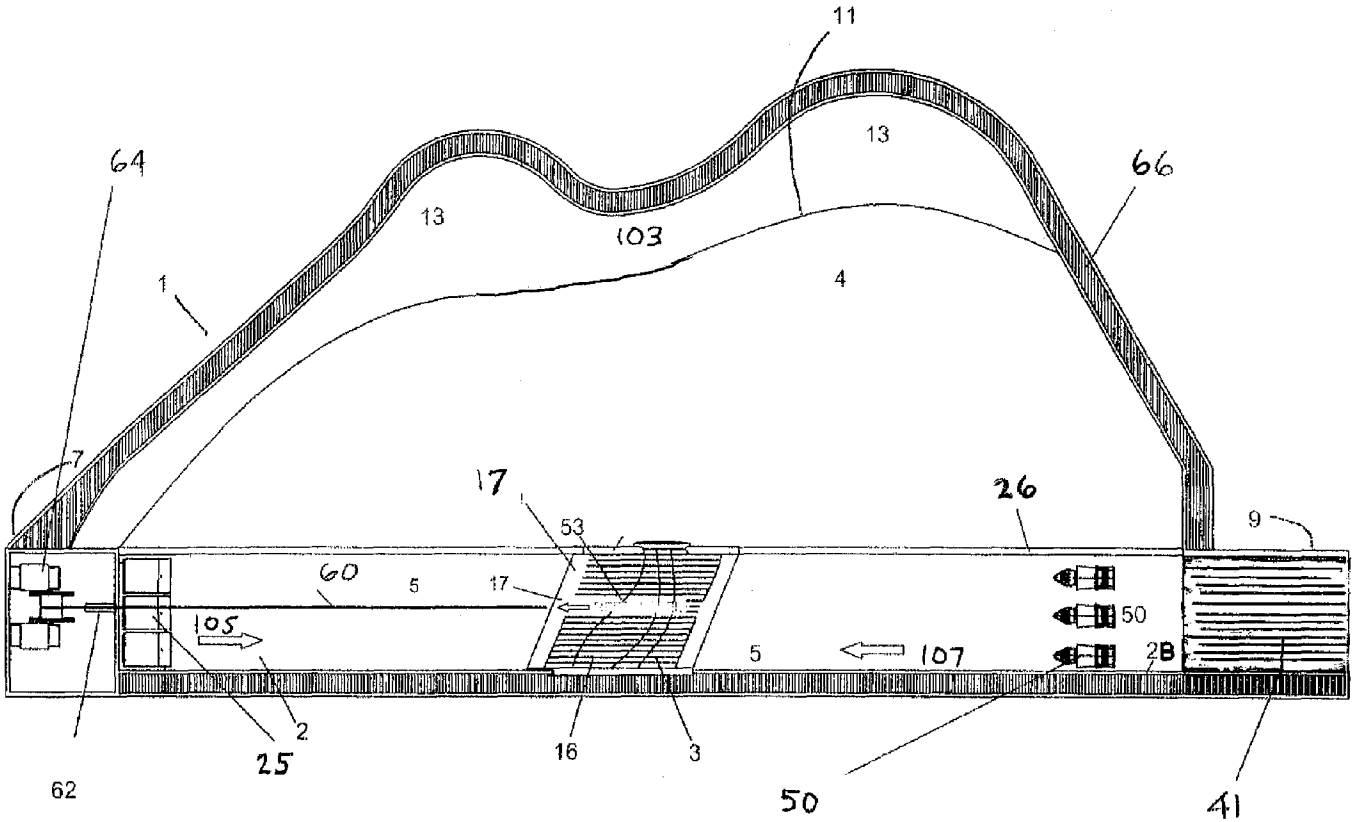
FIG. 6 is a plan view of an alternate embodiment of the present invention showing the channel through which the wave generator travels as well as the wave pool with a shoreline thereon, wherein the pumps that circulate water through the return culvert and onto the channel are located within the culvert at substantially the end of the channel opposite the end where the nozzles are located.

In the preferred embodiment, second body of water 2 is preferably adapted to flow through channel 5 against the forward movement of wave generator 3, wherein water is preferably injected onto channel 5 through nozzles 25 at end 7 so that the water travels through and across channel 5 in one direction as shown by arrows 105, until it reaches the opposite end 9 where a grate 41 is provided, as shown in FIGS. 1, 4*a* and 4*b*. Grate 41 allows water to be drawn down into a return culvert 43 which is preferably extended under plateau 14 and allows water on channel 5 to be re-circulated back in the opposite direction 107, as shown in FIG. 6, to opposite end 7, where the water can be re-injected through nozzles 25 onto channel 5. Channel 5 is preferably created on raised plateau 14 as shown in FIG. 3 above culvert 43 to allow the water on the channel to circulate from above the channel to below the channel and back up again. Culvert 43 as well as channel 5 and wave pool 1 and the surrounding areas can be made of concrete similar to a swimming pool or other conventional material. Grate 41 is preferably designed with multiple slits or openings so that water can freely pass through the grate and into culvert 43, wherein the openings are tight enough so that individuals and objects are prevented from being accidentally drawn into culvert 43.

The water is preferably injected onto channel 5 through one or more injection nozzles 25 on end 7, as shown in FIGS. 1 and 3, wherein water can be injected under pressure onto channel 5 to create a current that travels in a direction that extends from end 7 toward end 9 which is opposite the direction that wave generator 3 travels. As shown in FIGS. 5*a*, 5*b*, 8*a* and 8*b*, nozzles 25 are preferably adapted with a pivoting top plate 38 capable of adjusting the size or height of the nozzle opening to create different flow depths on channel 5. Adjacent top plate 38 is preferably an air bladder 40 which can be inflated to cause top plate 38 to hinge and drop down into the opening to adjust or reduce the flow depth, and which can be deflated to cause top plate 38 to rise up to adjust or increase the flow depth. The depth of flow on channel 5 is preferably adjustable within a certain range, i.e., the preferred flow depth of second body of water 2 is about six to eighteen inches, although any depth from about three inches to about three feet is contemplated.

Figure 5B:
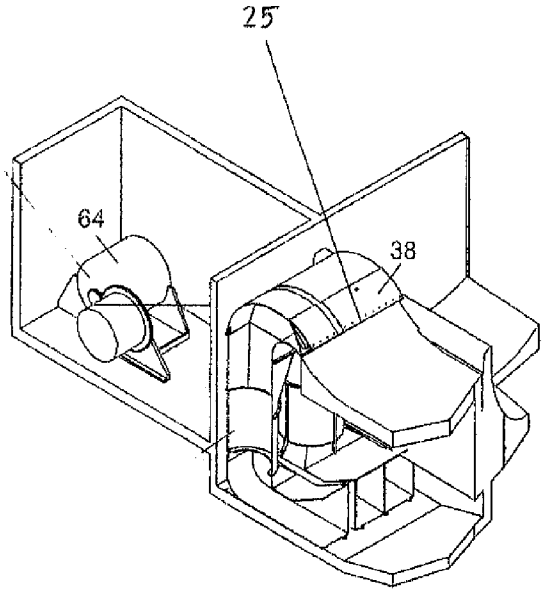
FIGS. 5*a* and 5*b* are details of the mechanical assembly of the embodiment of FIG. 1 located at the nozzle end of the channel where the water is extruded and injected onto the channel from the culvert below, wherein the pump assembly is located beneath the nozzles.
Figure 5A:
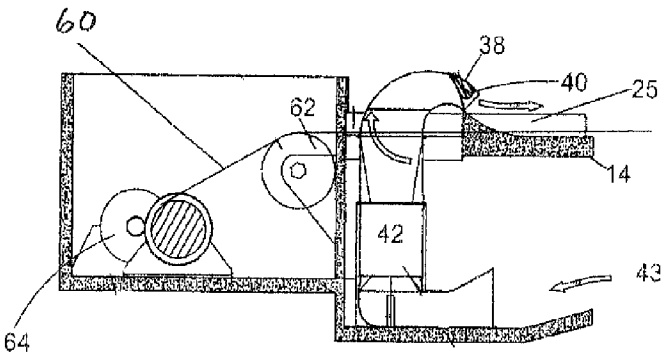

In the embodiment of FIG. 3, the nozzles 25 and pump 42 are preferably made as part of a single assembly. This is also shown in FIGS. 5*a* and 5*b*, wherein pump 42 is located immediately below nozzles 25. Pump 42 preferably has submersible pump mechanisms located inside a fluid drive unit to create the pressure needed to inject water through nozzles 25 onto channel 5 at a sufficient speed/rate.

Figure 7:
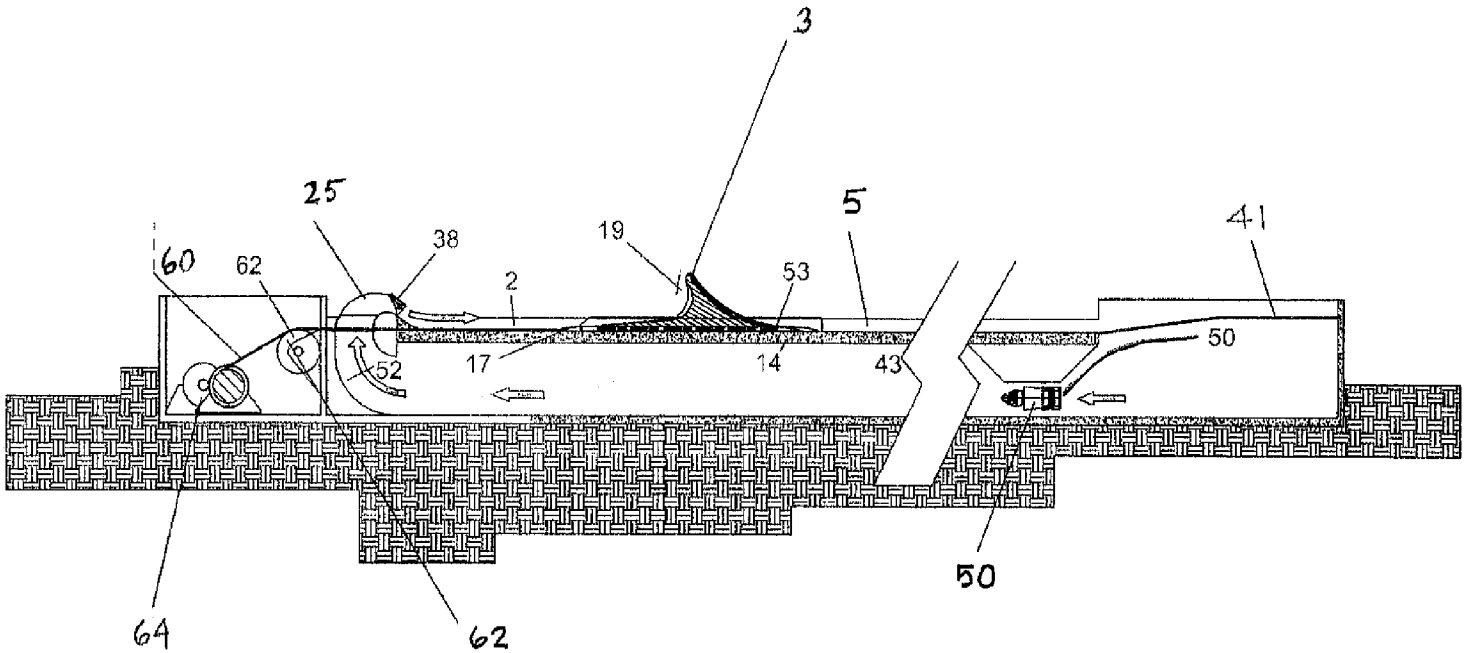
FIG. 7 is a typical cross section of the wave pool shown in FIG. 6 taken longitudinally along the length of the channel, showing the plateau on which the channel and wave generator are located, and the culvert underneath, as well as the pump within the culvert and the nozzles on the left end of the channel.
Figure 8B:
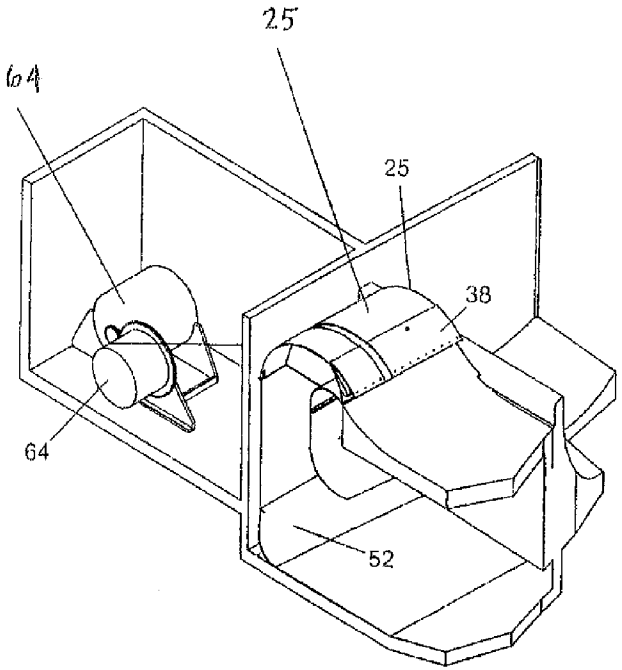
FIGS. 8*a* and 8*b* are details of the mechanical nozzle assembly of the embodiment shown in FIG. 6 located at the left end of the channel where the water is extruded and injected onto the channel from the culvert below.
Figure 8A:
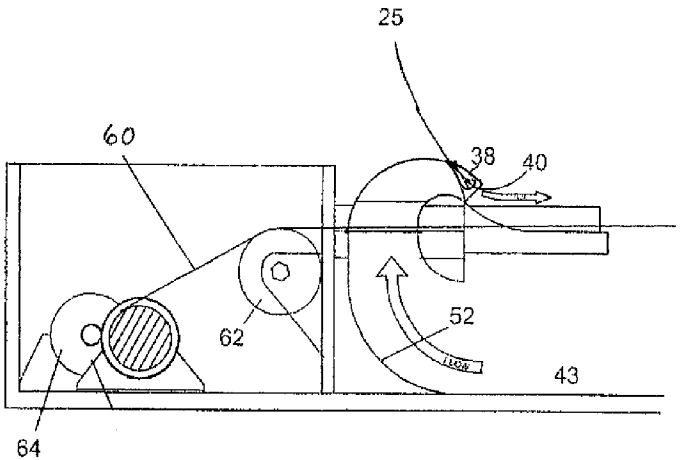

In the embodiment of FIGS. 6 and 7, however, pumps 50 are preferably located within culvert 43 at or near end 9 on the opposite end relative to nozzles 25. This is so that as water is being drawn into culvert 43, through grate 41, there is sufficient room and distance within culvert 43 to allow the water turbulence created by pumps 50 to subside by the time it reaches nozzles 25 for extrusion onto channel 5. In this embodiment, the assembly that houses nozzles 25 is as shown in FIGS. 8*a* and 8*b*, wherein water pressurized by pumps 50 is allowed to pass through a curved bend 52 before it is extruded through nozzles 25. In either case, the flow depth can be adjusted by using top plate 38 and bladder 40 as discussed above.

Wave generator 3 is preferably adapted to be situated on a moving platform 53 comprising extended wing section 16 as shown in FIGS. 9-11. Moving platform 53 is preferably substantially horizontally oriented and has a forward extended wing section 16 with a leading edge 17 that is preferably angled relative to channel 5 as shown in FIG. 1. It also preferably has a curved upper surface that gradually slopes upward toward curved flow forming surface 19. Wing section 16 and flow forming surface 19 preferably extend in a manner that allows water to climb up the incline and be acted upon such that it forms a wave formation upward and sideways toward wave pool 1. The height of flow forming surface 19 is preferably up to five feet or more, and provided with a sufficient curvature that allows the sheet flow of water to be acted upon both horizontally and vertically. Back down the slope on the opposite side of flow forming surface 19 preferably extends a trailing down slope surface 70 and trailing edge 72, as shown in FIG. 11. Leading edge 17 and trailing edge 72 can be flexible to maintain contact with channel 5.

Moving platform 53 preferably has a series of rollers 21 spaced a predetermined distance apart from each other to enable platform 53 to be sufficiently supported and roll freely on top surface 8 of channel 5. Any adjustment in the size and/or height of rollers 21 is preferably able to control the height at which platform 53 travels along channel 5 relative to top surface 8 of channel 5. Preferably, there are a sufficient number of rollers 21 to provide full support and adjustability for wave generator 3, wherein it can be seen that by adjusting rollers 21, platform 53 can be raised or lowered, or tilted slightly if desired. In addition to rollers 21 on the bottom of wave generator 3, side rollers 30 that extend laterally outward as shown in FIG. 10 can be provided to help brace wave generator 3 within channel 5 against divider wall 26 and outer wall 28 on either side. Side rollers 30 can be spring loaded and biased so that they continually apply pressure against divider wall 26 and outer wall 28 to maintain wave generator 3 on a straight path.

As seen in FIG. 10, extended on either side of platform 53 are preferably raised supports 55, 56 that serve as braces and buffers for wave generator 3 relative to channel walls 26, 28, including divider wall 26 on one side and outer wall 28 on the other side. For example, support wall 55 preferably extends up and over divider wall 26, as shown in FIGS. 9 and 10, and wraps around it as a measure of safety to keep participants from colliding into divider wall 26 or otherwise getting caught between leading edge 17 and divider wall 26. That is, by extending wing section 16 further forward of flow forming surface 19, and wrapping support wall 55 over and around divider wall 26, it can be seen that the riding surface of wave generator 3 is a contiguous surface that substantially prevents participants from accidentally hitting divider wall 26 or getting caught under wing section 16.

Likewise, support wall 56 preferably extends up and over outer wall 28, as shown in FIGS. 9 and 10, and wraps around it to provide a measure of safety to keep participants from engaging or otherwise colliding into outer wall 28. By wrapping support wall 56 over and around outer wall 28, it can be seen that the riding surface of wave generator 3 is contiguous and substantially prevents participants from accidentally colliding into outer wall 28 or otherwise getting caught between leading edge 17 and outer wall 28.

As mentioned previously, projecting outward from the inside of support walls 55, 56 and against channel walls 26, 28 are preferably side rollers 30 that help to keep platform 53 and therefore wave generator 3 moving forward in a straight path along channel 5. Side rollers 30 help to brace platform 53 against side impact loads so that as wave generator 3 moves forward, it will continue along a straight path, and avoid shifting from side to side.

Insofar as wave generator 3 is designed to travel through channel 5, and any participant riding on a wave created by wave generator 3 will also travel along channel 5 at substantially the same speed, any participant that falls might otherwise collide with channel walls 26, 28 and be injured thereby. But by providing raised support walls 55, 56 on either side of wave generator 3, which are preferably padded, a participant that falls down will not hit walls 26 or 28, and therefore, the likelihood that injury will result is minimized. Entire wave generator 3 is preferably provided with padding such as with foam and a water impervious top layer to reduce the likelihood of injuries occurring.

The leading edge 58 of support wall 55 is preferably tapered and extended in front of leading edge 17 of wing section 16, as substantially shown in FIG. 9. FIG. 9 shows support wall 56 and wall 55 preferably being configured in like manner, although support wall 55 is preferably not as tall as support wall 56. Likewise, even though support wall 55 extends above wing section 16 at leading edge 17, as one progresses from leading edge 17 to the crest of hull 18, the elevation of wing section 16 gradually increases such that by the time the water flowing over and across wave generator 3 reaches flow forming surface 19, it is sufficiently elevated so that it flows over support wall 55, wherein the water preferably forms a substantially thickened and smooth layer over which participants can maneuver and easily glide.

Flow forming surface 19 of hull 18 and platform 53 are preferably constructed contiguously using computer cut steel frames that create the desired wave forming shape as shown in FIG. 10 with a layer of fiberglass or other moldable and durable material on the exterior. As discussed, any of the previous wave generator hull shapes and construction techniques developed in conjunction with the previous wave generating systems and methods can be used in connection with the present invention. Preferably, the flow forming surface 19 has curvatures both horizontally and vertically and is configured to substantially scoop up a sheet flow of water such that as flow forming surface 19 acts upon the sheet flow, the water forms a wave formation thereon. It should be noted that because wave generator 3 as well as platform 53 will be moving in concert, along with any participant riding on wave generator 3, the wave generator will appear to be standing still relative to the participant thereon, even though the entire platform 53 will be moving through channel 5 at a predetermined speed. Likewise, from the participant's point of view, the sheet flow of water will appear to be flowing rearward relative to wave generator 3.

As shown in FIGS. 1, 3, 5*a*, 5*b*, 6, 7, 8*a* and 8*b*, wave generator 3 is preferably adapted to be pulled by a cable 60 powered mechanically around a pulley 62 by a drive mechanism 64. Cable 60 is preferably attached to the front of wave generator 3, at or near the center of leading edge 17 such that the forces acting on wave generator 3 while it is being pulled can help keep wave generator 3 in substantial equilibrium. Additional cables can also be provided and connected in a similar manner. Any other conventional pulling or driving means that achieves substantially the same results is also contemplated.

To operate wave generator 3, mechanical device 64 pulls cable 60 over pulley 62 to pull wave generator 3 through channel 5 at a predetermined speed relative to the moving body of water 2 within channel 5, thereby creating primary waves in front of wave generator 3 and secondary waves within wave pool 1. When wave generator 3 has traveled substantially across the length of channel 5 to end 7, the drive mechanism 64 preferably allows cable 60 to be released so that the momentum of the water flowing through channel 5 can help push wave generator 3 back in the opposite direction to the other end 9, whereupon wave generator 3 can be operated in the same manner again.

The speed and acceleration at which wave generator 3 travels through channel 5 is preferably adjustable such that optimum performance conditions can be created taking into account the various forces created by flowing body of water 2 acting on wave generator 3 within channel 5, as well as the friction and weight and momentum of the participants, etc. As discussed, the ideal absolute speed of wave generator 3 within channel 5 will depend on the speed at which the flowing body of water travels against it, wherein the greater the speed at which the flowing body of water travels, the lower the absolute speed at which wave generator 3 is required to travel. As discussed, the net speed of wave generator 3 relative to the flowing body of water will preferably be a summation of the absolute speed of wave generator 3 and the speed of the flowing body of water flowing against it. For example, if the absolute speed of wave generator 3 relative to the surrounding pool is 7.5 miles per hour (about 12.07 kilometers per hour), and the body of water flowing within channel 5 is flowing at the same speed of 7.5 miles per hour, but in the opposite direction, the net speed of wave generator 3 relative to the flowing body of water will be 15 miles per hour (about 24.14 kilometers per hour). So long as the summation equals an amount that approximates the ideal speed of 15 miles per hour (about 24.14 kilometers per hour) relative to the water, ideal surf conditions can be produced.

At the ideal speeds, wave generator 3 helps to lift a sheet flow of water onto wing section 16 and then up and laterally across flow forming surface 19, wherein the sheet flow creates primary waves 12. Primary waves 12 are preferably formed on or directly in front of and/or to the side of wave generator 3 as wave generator 3 pushes water and travels forward through channel 5 as shown in FIG. 13.

As wave generator 3 travels through channel 5, the energy and momentum of the water formed by wave generator 3 can be released from channel 5 and into first body of water 4 within wave pool 1 to create secondary waves 6 as shown in FIG. 13. The energy of the water being released into first body of water 4 within deep water environment 24 creates various water effects that can form swells that are eventually acted upon by the inclined slope of pool floor 10, wherein as the wake forms and travels toward shoreline 11, they are continually acted upon by the slope and incline of floor 10, which in turn, forms waves that eventually break along and spill onto beach 13.

This displacement and disturbance of water within wave pool 1 helps to create secondary waves 6 of a predetermined size and shape which in large part depends on the size and shape of primary waves 12 that are being created by wave generator 3. In this respect, it should be noted that similar waves traveling through a deep water environment will travel at a substantially constant speed through the surface of the body of water regardless of how fast wave generator 3 may travel through channel 5. That is, even if the absolute speed of wave generator 3 is reduced, with waves having a constant size (height/amplitude), the speed at which the secondary waves will travel toward the shoreline will remain substantially the same.

What can be affected by the change in absolute speed of wave generator 3, however, is the angle at which the secondary wave travels toward shore. For example, if the absolute speed of wave generator 3 is zero, i.e., it is stationary, the secondary waves formed thereby would spread out from a stationary point much like a ripple spreading out from a fixed point within a pond. Accordingly, the angle of the secondary waves created thereby would begin in a substantially circular configuration and travel outwardly from there in the shape of an arc toward the shoreline. But if the speed of wave generator 3 is increased to, say, infinity, the disturbance point within wave pool 1 would extend all the way across the channel in a single moment of time, and therefore, the displacement point would also extend linearly across the entire length of channel 5. One can see that, in such case, the secondary waves created by wave generator 3 would then tend to form in a substantially parallel direction relative to channel 5, and therefore, travel in a direction that is substantially parallel to channel 5 as it travels toward shoreline 11 directly across from it.

Of course, in reality, these are extreme examples, but they do illustrate the point that by adjusting the absolute speed of wave generator 3 relative to channel 5, the angle at which the secondary waves travel toward shoreline 11 can be adjusted. Therefore, by causing wave generator 3 to travel at some intermediate absolute speed—probably somewhere between 5 miles per hour (about 8.05 kilometers per hour) and 15 miles per hour (about 24.14 kilometers per hour), depending on the speed of the counter flow created in channel 5 as discussed above—the angle at which the secondary waves travel toward shoreline 11 can be adjusted as well. What this means is that by controlling the speed of the counter flow within channel 5, and the absolute speed of wave generator 3 (to maintain the ideal net speed of wave generator 3 relative to the water), the angle at which the secondary waves travel toward shoreline 11 can be adjusted to create different wave effects within body of water 4 within wave pool 1.

In this respect, it is also contemplated that the configuration of shoreline 11 and pool floor 10 can also be adapted and adjusted to accommodate the various angles at which the secondary waves will travel and break along shoreline 11 to provide a further means of adjusting the wave effects created within wave pool 1.

In the preferred embodiment, and as shown in FIGS. 1, 4*a*, 4*b*, 6, and 13, a perimeter grate system 66 that extends substantially along the perimeter of shoreline 11 can be provided to help attenuate secondary wave energy, so that as the waves break and spill onto the inclined beach 13, the energy from the waves can pass through the grate 66 and into a cavity below, such that rip currents and reverse flows that can otherwise result from the backflow of water can be avoided. Dampening features are disclosed in Applicant's U.S. Pat. No. 6,460,201, issued on Oct. 8, 2002, entitled "METHOD AND APPARATUS FOR CONTROLLING BREAK POINTS AND REDUCING RIP CURRENTS WITHIN A WAVE POOL," and in U.S. Application Ser. No. 61/200,183, filed on Nov. 25, 2008, entitled "METHOD AND APPARATUS FOR DAMPENING WAVES IN A WAVE POOL," which are incorporated herein by reference. As discussed in the patent identified above, a grate and cavity system can be provided with a dampening feature to prevent water from reflecting back into wave pool 1, as well as a circulation means to circulate water back into wave pool 1.

Figure 12A:
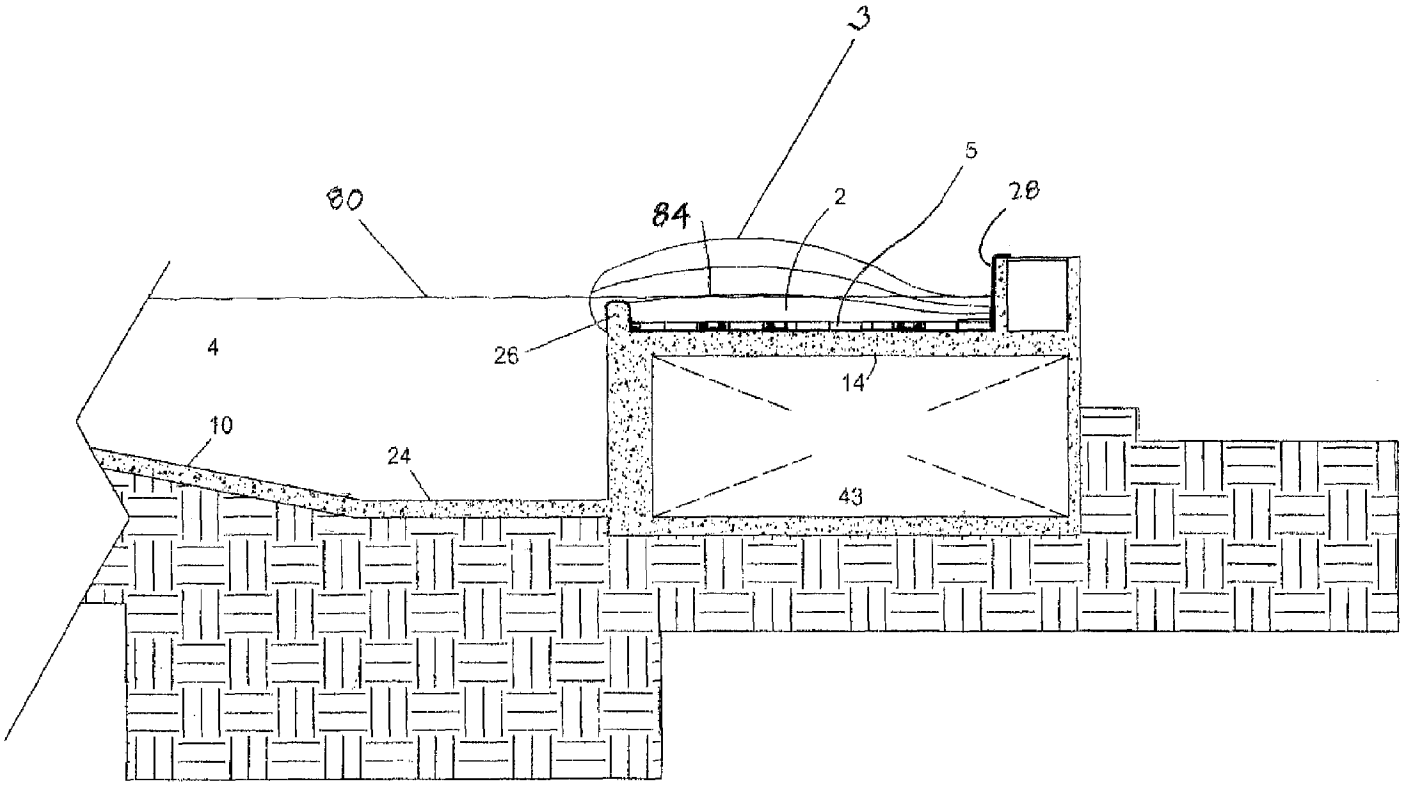
FIG. 12*a* shows an embodiment with the divider wall extended slightly below the water level within the wave pool which allows water from the wave pool to flow back into the channel.
Figure 12B:
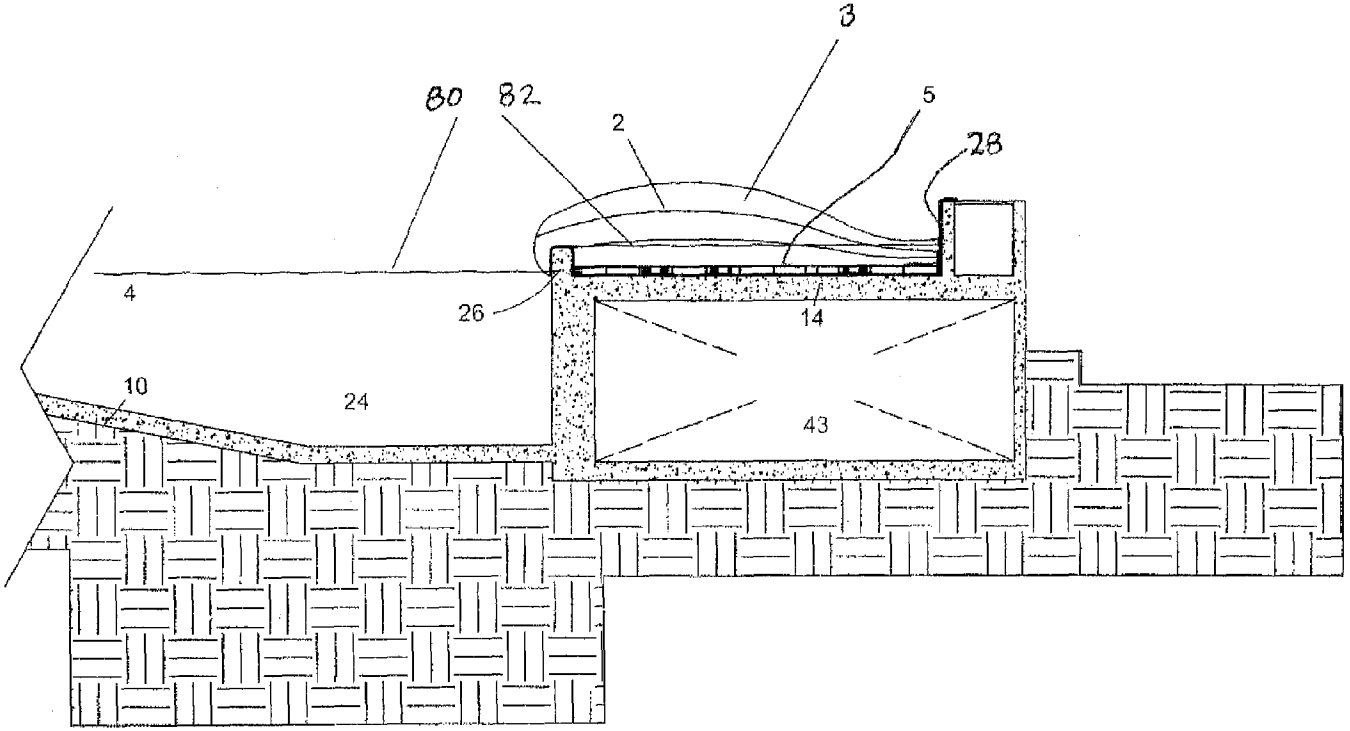
FIG. 12*b* shows an embodiment with the divider wall extended slightly higher than the water level in the wave pool which allows the channel's body of water to remain separated from the wave pool's body of water, wherein the level of the channel's body of water is higher than that of the wave pool's body of water.
Figure 12C:
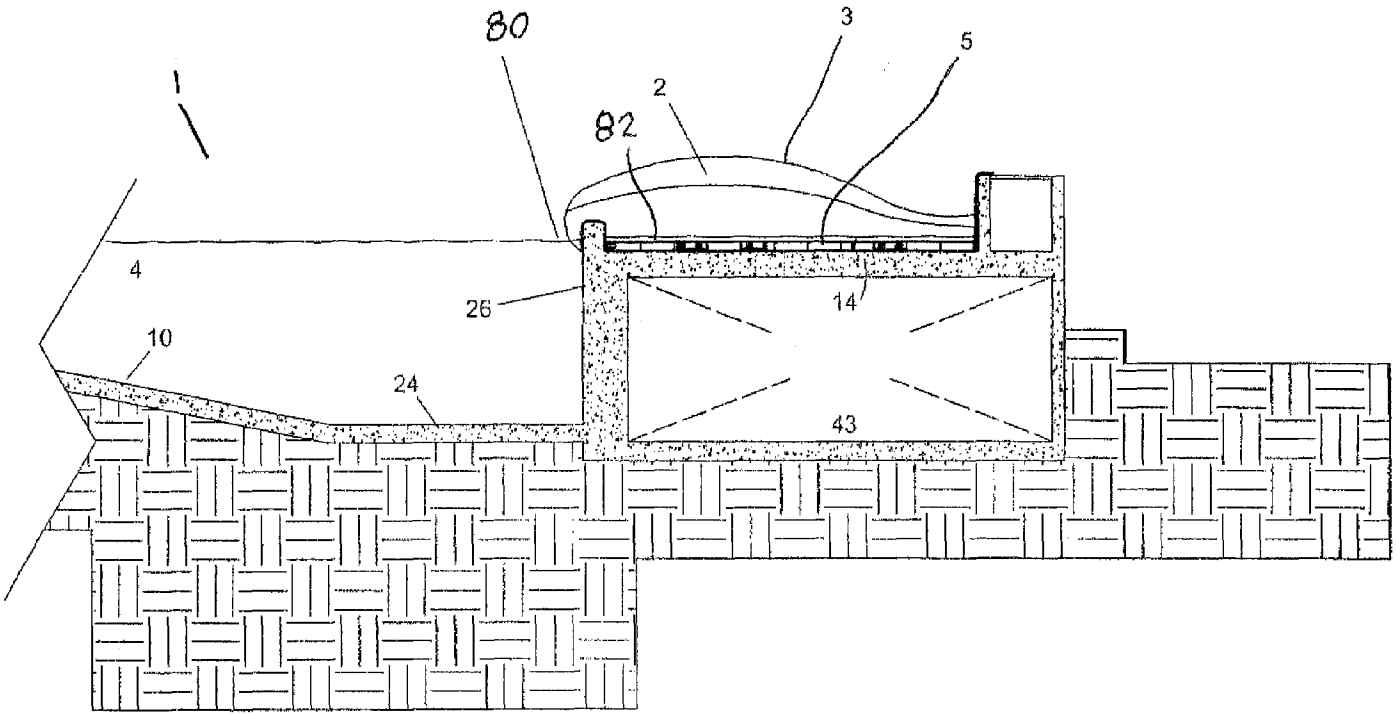
FIG. 12*c* shows an embodiment with the divider wall extended slightly higher than the water level in the wave pool which allows the channel's body of water to remain separated from the wave pool's body of water, wherein the level of the channel's body of water is substantially the same as that of the wave pool's body of water.

As shown in FIGS. 12*a*, 12*b* and 12*c*, the height of divider wall 26 can be adapted to suit a particular circumstance. For example, FIG. 12*a* shows divider wall 26 to be slightly below the mean water level 80 of body of water 4 within wave pool 1. This allows water in wave pool 1 to flow over divider wall 26 and back into channel 5 as water seeks its own level 84, which occurs after wave generator 3 has made its run, and a portion of the water from channel 5 has been transferred into wave pool 1.

FIG. 12*b* shows divider wall 26 slightly above the mean water level 80 of body of water 4 which allows water in wave pool 1 to be separated from body of water 2 within channel 5, and for the level 80 of the first body of water 4 and the level 82 of the second body of water 2 [two bodies of waters] to be independently controlled. This way, the level of water within channel 5 can be higher relative to the level of water in wave pool 1 as shown in FIG. 12*b* which advantageously enables water displaced by wave generator 3 to start out at a higher elevation than body of water 4. This also enables water within channel 5 to have a greater potential energy so that wave generator 3 can release more kinetic energy into wave pool 1 to create larger secondary waves. Additionally, since elevated water in channel 5 is separated from the water in wave pool 1, by divider wall 26, the motion of wave generator 3 as it moves through channel 5 has little effect on the water in wave pool 1. This separation advantageously avoids the creation of bow, stern and transom waves normally associated with a hull moving through a body of water. Of consequence, when in operation, lifting water in channel 5 forms primary wave 12 which drops into wave pool 1 and causes a continuing solitary disturbance that runs parallel to channel 5 and reforms into a soliton secondary wave 6 that ultimately breaks obliquely in a progressive manner along beach 13. A notable feature of this soliton wave is that it requires a less steep beach in order to break as a curling wave, e.g. in a range of 1 to 20 through 1 to 30. Likewise, as shown in FIG. 12*c*, with divider wall 26 slightly above the mean water level 80 of body of water 4, water within wave pool 1 can still be substantially at the same level as the water level 82 within channel 5, or slightly below, if desired. This allows the water level 82 within channel 5 to be adjusted independently from the water level 80 within wave pool 1.

The present invention enables the absolute speed of wave generator 3 to be reduced, while the net speed of wave generator 3 relative to the counter current to remain unchanged. That is, because body of water 2 will travel in a direction opposite that of wave generator 3, the delta speed between wave generator 3 and body of water 2 will be cumulative, i.e., it is typically the speed of the wave generator 3 plus the speed of the body of water. This enables wave generator 3 to be adapted to create substantially similar wave effects despite traveling at a slower absolute speed. For example, using the present invention, if the body of water 2 is moved in direction A, at a speed of 7 feet per second (about 2.13 meters per second), and wave generator 3 travels in the opposite direction B, at a speed of 15 feet per second (about 4.57 meters per second), the net speed of wave generator 3 relative to the body of water 2, would be 22 feet per second (about 6.71 meters per second). However, in this case, the waves can be created in about two-thirds of the space, since, with the wave generator 3 traveling at an absolute speed of 15 feet per second (about 4.57 meters per second), it would only need to travel an absolute distance of about 225 feet (about 68.58 meters), not 330 feet (about 100.58 meters), to operate for 15 seconds. This helps reduce the amount of land needed to install and construct the attraction and reduce the overall cost of construction.

It is also contemplated that various features of Applicant's present invention can be incorporated into a wave pool without using a counter current technology within channel 5. That is, when the scarcity and cost of land are less of an issue, wave pool 1 can be constructed without any means of causing second body of water 2 within channel 5 to flow in a reverse direction against the travel direction of wave generator 3. In such case, wave generator 3 could be configured and constructed and pulled across channel 5 in substantially the same manner as described above, but without the counter flow traveling against it. This would avoid the need for nozzles, pumps, suction grates, return culverts, etc. It would also avoid the need for divider wall 26, wherein body of water 4 within wave pool 1 could then be allowed to flow freely onto channel 5. That way, after each run, after wave generator 3 has lifted a portion of second body of water 2 within channel 5 onto wave generator 3 to create primary waves, water from wave pool 1 can then be allowed to flow freely back and fill channel 5 so that channel 5 will be ready to be used again.

Other embodiments and versions that are consistent with the above descriptions and/or perform in substantially the same manner and/or produce substantially the same results which may not be identical in every respect are intended to be included and contemplated within the scope of the following claims.

What is claimed is:

1. A wave generating system having first and second bodies of water therein, comprising:

a channel located adjacent said first body of water on which said second body of water is located;

a wave generator capable of traveling through said channel in a first direction to help lift up a portion of said second body of water and create primary waves;

a device for causing said second body of water to flow through said channel at a predetermined speed in a second direction opposite said first direction, wherein an absolute speed of said wave generator traveling in said first direction relative to said channel is reduced without substantially affecting a net speed at which said wave generator travels relative to said second body of water; and wherein said channel has a floor that is higher relative to a floor of said first body of water adjacent said channel, wherein the floor of said first body of water adjacent said channel forms a substantially deep water environment, such that as the wave generator travels through said channel and generates the primary waves, energy and water effects created by the primary waves are released into said first body of water, wherein swells and secondary waves are created within said first body of water that travel across said first body of water toward an inclined shoreline.

2. The wave generating system of claim 1, wherein said device comprises at least one nozzle and pump for injecting water onto said channel.

3. The wave generating system of claim 1, wherein said second body of water is allowed to travel in said second direction within said channel from a first end to a second end, and a return culvert is provided under said channel that allows water within said second body of water to circulate back from said second end to said first end.

4. The wave generating system of claim 3, wherein at least one nozzle is located at said first end for injecting water onto said channel, and a pump is located substantially at or near said second end, opposite said first end, wherein the location of said pump helps to reduce the turbulence created by said pump before water in said return culvert reaches said at least one nozzle at said first end.

5. The wave generating system of claim 3, wherein a return grate is provided at said second end of said channel to enable water from said second body of water to drop down from said channel and into said return culvert.

6. The wave generating system of claim 1, wherein a divider is provided along said channel to substantially separate said first body of water from said second body of water, wherein said divider is adapted with a predetermined height that helps to prevent said first body of water from interfering with said second body of water, but enables the energy and water effects created by the primary waves to enter into and affect said first body of water, which in turn, helps to create the secondary waves.

7. The wave generating system of claim 1, wherein said wave generator comprises a forward extended wing section having a leading edge and a flow forming surface thereon having an incline for creating the primary waves.

8. The wave generating system of claim 7, wherein said wing section extends substantially horizontally such that as said wave generator travels forward and said leading edge cuts through said second body of water, a portion of the water in said second body of water is lifted up onto said wing section to form a flow of water thereon, wherein said flow of water is acted upon by said incline of said flow forming surface to create the primary waves.

9. The wave generating system of claim 8, wherein said leading edge of said wing section extends a distance of about fifteen to twenty-five feet in front of said incline of said flow forming surface and is extended at an oblique angle relative to the first direction of said channel.

10. The wave generating system of claim 1, wherein said second body of water within said channel has a substantially constant depth and extends no more than about three feet deep, and wherein said first body of water is deeper than said second body of water and ranges between about three feet to six feet deep.

11. The wave generating system of claim 7, wherein said leading edge of said wave generator travels less than about three inches but more than about one inch above a top surface of said channel.

12. The wave generating system of claim 7, wherein at least one of the following is adjustable: depth of said second body of water within said channel, or height at which said leading edge travels relative to a top surface of said channel.

13. The wave generating system of claim 1, wherein a cable and pulley system is provided to pull said wave generator through said channel, wherein said cable and pulley system is adapted such that when said wave generator has completed a run, said wave generator is released such that the flow of water in said channel will cause said wave generator to travel in said second direction opposite said first direction.

14. The wave generating system of claim 6, wherein a portion of said wave generator is adapted to extend over said divider to prevent participants riding on said primary waves from colliding into said divider.

15. The wave generating system of claim 6, wherein said divider extends slightly above a mean water level of said first body of water and wherein a top surface of said second body of water in said channel can be raised above the mean water level of said first body of water.

16. The wave generating system of claim 1, wherein said wave generator has rollers or wheels which allow said wave generator to move freely within said channel.

17. The wave generating system of claim 16, wherein a predetermined number of wheels are provided to help brace said wave generator vertically and laterally such that said wave generator can travel substantially in said first direction without shifting substantially from side to side.

18. A wave generating system having first and second bodies of water therein, comprising:

a channel located adjacent said first body of water, wherein a divider extending along an edge of said channel physically separates said first body of water from said second body of water, wherein said divider extends above a [the standing] mean water level of said first and second bodies of water, such that a top surface elevation of said second body of water is capable of being altered relative to a top surface elevation of said first body of water;

a wave generator traveling in a first direction substantially parallel to the longitudinal direction of said channel, wherein said wave generator travels through said second body of water to create primary waves thereon, wherein as the wave generator travels through said channel and generates the primary waves, energy and water effects created by the primary waves are released over said divider and into said first body of water, wherein secondary waves are created within said first body of water that travel across said first body of water toward an inclined shoreline; and said wave generator comprises a forward extended leading edge and a flow forming surface having an incline thereon for creating the primary waves, wherein as said wave generator travels forward a portion of said second body of water is lifted up onto said flow forming surface is acted upon by said incline to create the primary waves.

19. The wave generating system of claim 18, wherein said divider is adapted with a predetermined height that helps to prevent said first body of water from interfering with said second body of water, but enables the energy and water effects created by the primary waves to enter into and affect said first body of water, which in turn, helps to create the secondary waves.

20. A wave generating system comprising:

a first body of water separated from a second body of water by a divider;

a wave generator adapted to travel in a first direction through said second body of water to create primary waves thereon, wherein said wave generator travels through a channel on which said second body of water flows;

wherein the energy and water effects created by the primary waves are released over said divider and into said first body of water, wherein secondary waves are created within said first body of water that travel toward an inclined shoreline; and wherein at least one nozzle for injecting water and creating a flow of water in a second direction on said channel is provided, wherein the flow of water travels in said second direction opposite said first direction of said wave generator.

21. The wave generating system of claim 20, wherein said at least one nozzle is located at a first end of said channel, and a grate is provided at a second end of said channel, opposite said first end, and a return culvert is provided that allows water within said second body of water to circulate back from said second end to said first end.

22. The wave generating system of claim 21, wherein a pump is located at or near said second end, wherein the location of said pump helps to reduce turbulence created by said pump as water in the return culvert circulates toward said first end.

23. A wave generating system comprising:

a first body of water separated from a second body of water by a divider;

a wave generator traveling within a channel in a first direction through said second body of water to create primary waves thereon, wherein the energy and water effects created by the primary waves are released over said divider and into said first body of water, wherein secondary waves are created within said first body of water that travel toward an inclined shoreline; and wherein said second body of water within said channel has a substantially constant depth and extends no more than about three feet deep, and wherein said first body of water is deeper than said second body of water and ranges between about three feet to six feet deep.

24. The wave generating system of claim 18, wherein said leading edge of said wave generator is extended forward relative to said flow forming surface by about fifteen to twenty-five feet, and said leading edge of said wave generator travels less than about three inches but no less than about one inch above a top surface of said channel.

25. The wave generating system of claim 18, wherein at least one of the following is adjustable: depth of said second body of water within said channel, or height at which said leading edge travels relative to a top surface of said channel.

26. The wave generating system of claim 20, wherein said channel has a floor that is higher relative to a floor of said first body of water adjacent said channel, wherein said floor of said first body of water adjacent said channel forms a substantially deep water environment.

27. The wave generating system of claim 18, wherein a portion of said wave generator is adapted to extend over said divider to prevent participants riding on said primary waves from colliding into said divider.

28. The wave generating system of claim 18, wherein said wave generator has rollers or wheels which allow said wave generator to move freely within said channel, and help brace said wave generator vertically and laterally such that said wave generator can travel substantially in said first direction without substantially shifting from side to side.

* * * * *